United States Patent [19]

Rosenstock

[11] Patent Number: 4,550,786

[45] Date of Patent: Nov. 5, 1985

[54] METHOD OF DRIVING STEEL PROFILES INTO A ROCK SUBSTRATUM

[76] Inventor: Winfried Rosenstock, Heyestrasse 28, 3063 Obernkirchen, Fed. Rep. of Germany

[21] Appl. No.: 564,710

[22] Filed: Dec. 23, 1983

[30] Foreign Application Priority Data

Dec. 23, 1982 [DE] Fed. Rep. of Germany ..... 3248430

[51] Int. Cl.[4] ..... E21B 43/11

[52] U.S. Cl. ..... 175/2; 405/231; 405/234; 102/312

[58] Field of Search ..... 175/2; 405/227, 231, 405/232, 234; 102/311, 312

[56] References Cited

U.S. PATENT DOCUMENTS

| | | | |
|---|---|---|---|
| 3,687,075 | 8/1972 | Fritz | 102/312 |
| 3,831,386 | 8/1974 | Phares et al. | 405/234 |

FOREIGN PATENT DOCUMENTS

| | | | |
|---|---|---|---|
| 0083674 | 4/1921 | Austria | 405/234 |
| 0715314 | 12/1941 | Fed. Rep. of Germany | 405/231 |
| 45-20337 | 10/1970 | Japan | 405/234 |
| 0861471 | 9/1981 | U.S.S.R. | 405/234 |
| 0926155 | 5/1982 | U.S.S.R. | 405/234 |

*Primary Examiner*—Stephen J. Novosad
*Assistant Examiner*—William P. Neuder
*Attorney, Agent, or Firm*—Dressler, Goldsmith, Shore, Sutker & Milnamow, Ltd.

[57] ABSTRACT

A method for the driving of steel profiles into a rock substratum is described, in which, before the driving, holes are drilled into the rock substratum, in which holes explosive charges are detonated. The explosive charge is so constructed and dimensioned that only the shock waves of the explosion act upon the rock, and not the combustion gases, so that the rock is only shattered in its internal structure but is not driven away. In the construction of a sheet pile wall, the holes are provided with explosive in mutually overlapping zones of differing depths, zones of the same depth being detonated at the same time and the charge in each hole being provided at top and bottom with a detonator each.

7 Claims, 2 Drawing Figures

METHOD OF DRIVING STEEL PROFILES INTO A ROCK SUBSTRATUM

Figure 1:
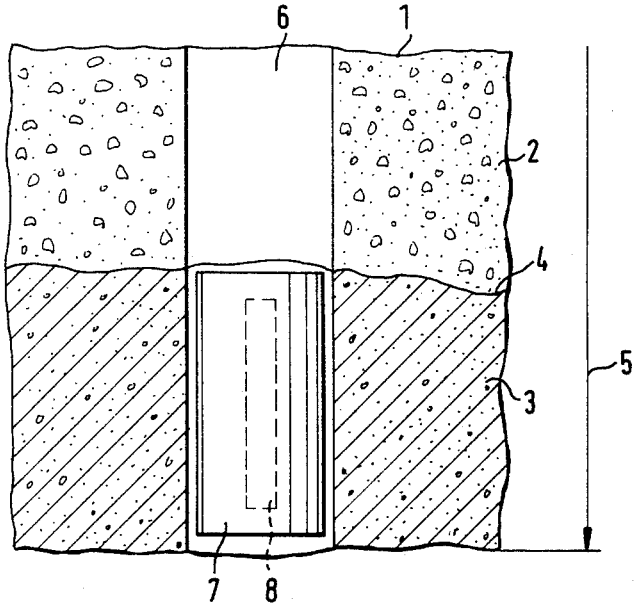

In construction projects in towns, for example for constructing foundations for high buildings or constructing traffic structures and also in projects constructed in water, for example in the extension of harbours and waterways, individual steel profiles or rows of steel profiles frequently have to be driven into the substratum to a predetermined depth. Frequently, however, this required depth of driving cannot be attained, because at only a slight depth a rock substratum is present within the soil structure, which does not permit driving beyond this depth.

Such a depth of driving limited by a rock substratum is unimportant when the lower ends of the steel profiles can be so fixed in the rock substratum that the profiles obtain sufficient support even without reaching the theoretically determined driving depth based upon soft ground conditions. If the profiles have sharp bottom edges, their lower ends can usually be driven, where the rock substratum is comparatively soft, without excessive difficulty to a penetration depth adequate for a secure support. With a harder rock substratum, this simple driving can, however, no longer be attained, because the lower ends of the profiles become upset when driving is attempted or they buckle sideways.

For these difficult soil conditions, a method of constructing a sheet pile wall is known, in which the sheet piles are no longer driven but are set into a trench blasted in the rock substratum and are concreted in there by underwater concrete. This method is extremely difficult and expensive, because before the usually V-section trench can be blasted out all rubble and the like overlying the rock substratum must be removed, For which purpose angles of slope of 1.3 must be observed for a loose overburden, to provide reliable assurance that the trench will not become filled after blasting. After the positioning of the sheet piles in the V-trench and the subsequent concreting operation, it is frequently necessary to backfill the rubble which has been removed with such effort, in order to assure the final stability of the driven sheet piles.

It is also known, in order to drive the lower end of a steel profile into a rock substratum, to drill a hole into the rock before driving, into which hole an explosive charge is introduced and detonated, so that the rock surrounding the drilled hole is thereby shattered and consequently much less resistance is offered to the driving of the steel profile.

In this known method, the borehole is completely filled with explosive material, so that as a consequence, when the explosive charge is detonated, not only is the rock surrounding the borehole shattered but, due to the gases expanding by the sudden combustion of the explosive charge, an upwardly open, funnel-shaped space is also created. This means, however, as in the above described method, in which a trench was blasted into the rock substratum, that the steel profile can only be inserted or further driven into the substratum exposed by the blasting, without however adequate fixity being obtained. This fixity must then be produced by additional measures, such as the placing of underwater grout or chemical products. Here again, therefore, we have a complicated method.

In marine and inland waterway projects blasting techniques of the above described type may indeed still be useful, but such favourable conditions as a rule do not exist for construction projects in towns. In the building of traffic routes, for example tunnel tubes for underground railways, blasting cannot normally be carried out in boreholes, because damage could be caused to neighbouring buildings. On the other hand, damage can be caused solely by the driving operation, if the steel profiles are long and no rocky substratum is present. Other complicated procedures have therefore frequently been used for this purpose, for example the construction of diaphragm walls and the like.

This invention starts from a method for the driving of the lower end of a steel profile or section into a rock substratum, wherein a hole is drilled into the rock substratum before the driving, in which hole an explosive charge is detonated.

The task underlying the present invention is to create a method of the aforementioned type which, without additional measures, gives an immediate firm fixity to the steel profile or a row of steel profiles after the driving operation has been completed, and which also can be used in densely populated areas.

The stated task is achieved according to this invention in that the explosive charge is so constructed and dimensioned that only the shock waves of the explosion act upon the rock, whereas an action upon the rock of the gases expanding due to the combustion of the explosive material is largely eliminated.

In a further embodiment of the invention, a container containing an explosive charge is introduced into the borehole, the volume of this container being large compared with the volume of the explosive charge.

By the invention the result is achieved that, in contrast to the known method in which the borehole is completely filled with explosive, only a comparatively small explosive charge is used, which can indeed exert its full shock effect in a lateral direction on the rock at the explosion, but the expanding gases of which resulting from the combustion encounter a sufficiently large volume in the container to be able initially to expand therein without acting upon the rock adjacent to the borehole in such a manner that this rock is displaced. The explosion gases, which cannot act downwards on account of the massive rock substratum, therefore escape out of the container upwardly into the borehole, without however the otherwise usual blasting funnel being produced. By the invention the result is therefore achieved that the rock adjacent to the borehole is not blasted away but is shattered into extremely small particle fractions having a size of less than 0.5 cm. Into a rock substratum prepared in this manner, the steel profile can then be driven without particular difficulty and without risk of upsetting or buckling the lower end of the profile, the rock material displaced during driving causing a compaction of the substratum loosened by the blast, so that the profile is firmly and reliably held in the substratum.

Preferably, two bores adjacent to each other are constructed at a predetermined spacing for one steel profile, into each of which bores at least one container containing an explosive charge is introduced, and the explosive charges are detonated simultaneously in both boreholes, the spacing between the boreholes being preferably approximately ten times the borehole diameter. As a result, the action of the shock waves upon the rock can be considerably intensified and virtually the entire rock structure situated between the boreholes can be loosened, so that even wide steel profiles, such as sheet piles, can be easily driven.

In the same manner, this principle can be used also in the construction of sheet pile walls, in that holes are drilled at predetermined intervals in the direction of the later extent of the sheet pile wall, the explosive charges of at least two adjacent holes being simultaneously detonated.

In this connection it is of especial advantage if the containers containing an explosive charge are disposed in adjacent boreholes in at least two zones, which are situated at different depths. The zones should overlap in a vertical direction. This overlapping is important, because the propagation of the shock waves is dependent upon the cross-section of the charge and an effect in a vertical direction does not occur.

If, in each zone of adjacent boreholes, a detonator is disposed at top and bottom in the container equipped with an explosive charge and both detonators are detonated simultaneously, opposably acting shock wave fronts are created in each borehole, by which the desired effect is considerably strengthened, because the shock waves are added to each other so that the quantities of explosive used can be reduced.

The zones can be created in a simple manner by the adjacent boreholes being drilled alternately to different depths.

The method of this invention has the advantage that even piles of 20 m length or more, as are frequently required today in the construction of traffic routes, can be driven in one operation with so little vibration that even buildings standing in the immediate neighbourhood are assured against damage.

If a rock substratum which cannot be driven through is present, the method of this invention can be used also advantageously for the lateral anchorage of a sheet pile wall. After the erection of a sheet pile wall, that is after individual sheet piles have been driven, it may be necessary to secure the upper end of the sheet pile wall against displacement, which is usually achieved by the assistance of anchors which run approximately at 45° obliquely from the upper edge of the sheet pile wall downwards. An anchorage of this type is provided especially for sheet pile walls which are subjected to high soil pressure on one side, and which find fixity in the driven state only at the lower end as a consequence of the soil structure present. These conditions very frequently occur in the securing of banks and in the construction of quay structures on waterways, at which a rock substratum is present at the interface between water and land. As a result of the fact that, in the method of this invention, a recompression of the material surrounding the driven pile takes place during driving, considerably greater holding forces are generated than have hitherto been possible with the methods so far used.

Figure 2:
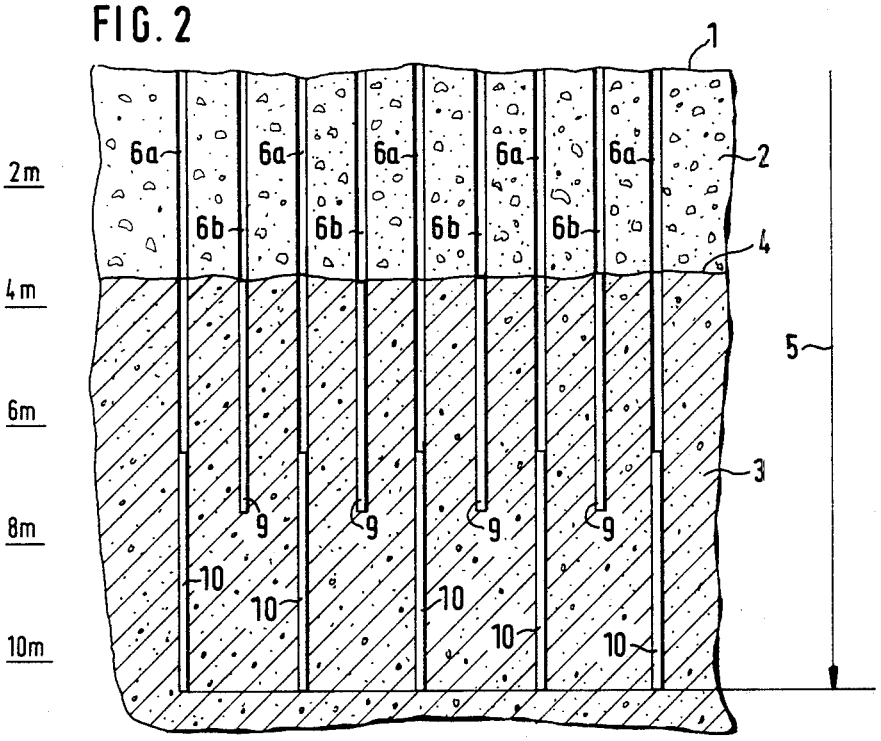

The invention is explained in more detail below with reference to the drawing. This shows:

FIG. 1 a diagrammatic sectional view of a borehole drilled in a rock substratum with explosive charge inserted therein, and FIG. 2 a diagrammatic lateral view of a row of boreholes.

FIG. 1 shows in section the structure of a substratum, into which a steel profile is to be driven by the method of this invention. Immediately below the surface 1 of the substratum there is a comparatively soft stratum 2, which offers no resistance to driving, and which in turn is followed by a rock stratum 3, the upper face of which is referenced 4. The arrow 5 denotes the depth to which a steel profile or section is to be introduced into the rock stratum 3.

FIG. 1 shows the state in which a borehole 6 has already been constructed and a container 7, with explosive charge 8 disposed therein, has been placed in the region of the borehole which passes through the rock layer 3.

For centering the explosive charge 8 inside the container 7, no special precautions in general have to be taken, since it is not of importance for the described effect of pre-expansion whether the explosive charge, usually placed in the form of cords, bears against the wall of the container or is situated in the centre. If, for any reasons however, centering is desired, appropriate spacers may be used. The only important aspect is that a sufficiently large gas space, which serves as expansion space, shall be available inside the container. The smaller this expansion space is, the more the explosive charge will have a tendency to shoot away, that is to displace, the rock surrounding the borehole, and if an expansion space is completely lacking, only this last-named effect would occur.

The container 7 should preferably be of plastics material, but in any case not of metal, if, after detonation of the explosive charge, parts of the container remain in the region into which the steel profile is to be driven, then any plastics residues will never impede the driving movement, whereas pieces of metal could cause an impediment. In the simplest method, the containers are formed by repeatedly cutting lengths from PVC tubes, the ends of the tube lengths then being closed by appropriate caps. Tubes of this type are commercially available as drainage pipes etc., at favourable prices.

To enable the container 7 to be sunk down to the desired position, a tube can be lowered to follow the drilling of the borehole 6, this tube then preventing falling in of the overburden layer 2 into the borehole. This measure is necessary especially when the rock substratum is under water. After the container has been introduced through the pipe, the latter can immediately be removed. Even if the bore then again becomes filled with loose material, this has no adverse influence upon the effect of the explosion.

Instead of a single container 7, a plurality of containers can also be disposed one above another, and also several explosive charges can be placed inside one container.

The diameter of the borehole 6 before blasting is preferably approximately 30 to 65 mm. After the detonation of the explosive charges, the size of which will be determined from experience obtained from preceding test explosions, a region of approx. 500 mm diameter around the hole along its axis is as a rule destroyed in its internal structure by the explosion. From the external diameter of the hole to the boundary of this altered zone, the compaction of the rock progressively decreases when the profile has been driven. The profile is driven centrally to the borehole. For sheet pile walls, for example, two mutually adjacent boreholes can also be drilled for one and the same pile, the centres of the holes being located approximately in the region of the outer edges of the sheet pile during driving. In this case, the explosive charges are simultaneously detonated in both the holes, with the result that on account of the superposition of the shock waves, the effect is intentionally intensified in a preferred direction.

In the construction of a wall steel profiles or sections, the procedure is the same. Here, the explosive charges in groups of adjacent boreholes are simultaneously detonated.

FIG. 2 shows one especially advantageous application of the method of this invention in the construction, for instance, of a sheet pile wall. Here again a section is shown through ground comprising a rock stratum 3 and an overburden 2, consisting of rubble, sand or other comparatively soft soil layers. Into this ground, a row of bores 6*a* and 6*b* is formed at uniform intervals, the bores 6*a* extending as far as the depth indicated by the arrow 5, whereas the boreholes 6*b* penetrate to a lesser depth into the rock stratum 3. The holes 6*b* are also all of approximately the same depth, and holes 6*a* and 6*b* alternate. The depths of the holes 6*a* is here approximately 11 m, whereas the holes 6*b* have a depth of only about 7 m. The depth to which the piles are to be driven corresponds to the depth of the boreholes 6*a*.

Into the lower ends of each of the boreholes, one or more containers 7 with explosive charges situated therein are then introduced, as already described in relation to FIG. 1 and optionally with the temporary introduction of tubes, the zones 9,10 of adjacent boreholes in which explosive charges are situated having a mutual overlap, which preferably is approximately 1 m.

In the case where a sheet pile wall is to be constructed in a body of water, antiflotation brakes can be fitted to the containers 7, which brakes lie close to the container while the container is being pushed into the borehole and, when a movement directed outwards from the borehole occurs, splay out and thus fix the container inside the borehole. After the removal of the temporary tubes, rubble can trickle back from the overburden 2 into the borehole 6 without disadvantage, since the subsequent blasting is not adversely affected by it.

Detonation is carried out according to the invention as follows: first the explosive charges in at least two adjacent zones 10 having the one depth and then the explosive charges in at least two adjacent zones 9 having the other depth are detonated, so that zones meshing into one another are therefore detonated at different times. In the present example, therefore, the explosive charges in the boreholes 6*a* are first detonated and then the explosive charges in the boreholes 6*b*.

Preferably, in each zone 9, 10 of adjacent boreholes, one detonator is disposed each at top and bottom, the detonators inside one borehole being simultaneously detonated. As a consequence shock wave fronts are created acting in opposite directions in each borehole and as a result of the addition of the shock waves the quantity of explosive can be reduced.

In FIG. 2, only two zones 9 and 10 having differing depths are provided. A division into three or more zones could, of course, also be used and these would then mutually overlap.

After the exploding of a section or of all explosive charges in the containers 7, hardly any modification has occurred to the general soil structure. As previously, the overburden overlies an externally scarcely modified rock substratum 3, into which, however, driving can now be carried out. Any container residues which may remain inside the rock substratum 3 have no adverse effect upon later driving, since they are forced to the side by the driven steel profile or, in the case of a sheet pile, are cut through by its lower edge. It has been found that usual sheet piles can be driven into the rock substratum 3, shattered in its internal structure, with a number of blows of 25 to 40, in the extreme case 50 blows per 10 cm.

The method of this invention for driving steel profiles has been described in relation to a soil situation in which an overburden 2 possibly with water above it is present above the rock substratum 3. The method of this invention can, of course, be used also for making drivably a rock substratum 3 which lies exposed without such overburden 2. Such a very simple soil situation is, however, seldom encountered, so that an overburden can be regarded as the normal case. The method of this invention for the driving of sheet piles is especially advantageous and inexpensive here.

I claim:

1. A method of driving the lower ends of sheet piles into a rock substratum for the purpose of constructing a sheet pile wall, comprising the steps of boring boreholes in the rock substratum at predetermined intervals along the intended sheet pile wall, inserting at least one closed container containing an explosive charge into each borehole and disposing the containers in adjacent boreholes in at least two zones located at different depths, selecting a small volume of the explosive charge relative to the volume of the container, first detonating the explosive charges in at least two adjacent zones at one depth and then the explosive charges in at least two adjacent zones at a different depth to shatter the rock substratum in its internal structure but leave the substratum almost undamaged in its external form between the boreholes and subsequently driving sheet piles into the disintegrated rock substratum.

2. Method according to claim 1, characterized in that the zones (9,10), equipped with explosive charges, of adjacent boreholes (6*a*, 6*b*) overlap in the vertical direction.

3. Method according to claim 2, characterized in that the overlapping of the zones (9,10) amounts to at least one meter.

4. Method according to claim 3, characterized in that firstly the explosive charges in at least two adjacent zones (10) at one depth and then the explosive charges in at least two adjacent zones (9) at a different depth are detonated.

5. Method according to claim 4, characterized in that, in each zone (9,10) of adjacent boreholes (6*a*, 6*b*), a detonator is disposed at top and bottom in the container equipped with an explosive charge (8), and that both the detonators are simultaneously detonated.

6. Method according to claim 1 characterized in that the distance between adjacent boreholes containing an explosive charge being preferably approximately equal to ten times the borehole diameter.

7. Method according to claim 6, characterized in that the zones (9,10) are located in the adjacent boreholes (6*a*, 6*b*) that are drilled alternately to different depths.

* * * * *